US009334148B2

(12) United States Patent
Bond et al.

(10) Patent No.: US 9,334,148 B2
(45) Date of Patent: May 10, 2016

(54) BEVERAGE DISPENSER FOR REFRIGERATOR

(71) Applicant: Nostalgia Products Group LLC, Green Bay, WI (US)

(72) Inventors: Gregg Bond, Beverly Hills, CA (US); Edward E. Boughton, III, Ventura, CA (US)

(73) Assignee: NOSTALGIA PRODUCTS GROUP LLC, Green Bay, WI (US)

( * ) Notice: Subject to any disclaimer, the term of this patent is extended or adjusted under 35 U.S.C. 154(b) by 44 days.

(21) Appl. No.: 14/312,618

(22) Filed: Jun. 23, 2014

(65) Prior Publication Data

US 2015/0368085 A1 Dec. 24, 2015

(51) Int. Cl.
*B67D 7/06* (2010.01)
*B67D 1/08* (2006.01)

(52) U.S. Cl.
CPC ..... *B67D 1/0857* (2013.01)

(58) Field of Classification Search
CPC .. B67D 1/0857; B67D 1/0082; B67D 3/0009; B67D 3/0025; B67D 3/00
USPC ..... 222/129, 144.5, 146.6, 181.1, 182, 482, 222/505, 545
See application file for complete search history.

(56) References Cited

U.S. PATENT DOCUMENTS 667,301 A * 2/1901 Dredge ..... B67D 1/1444 137/238
1,454,340 A * 5/1923 Schutt ..... B67D 3/0025 251/116
3,455,332 A * 7/1969 Cornelius ..... B01F 5/0077 137/381
3,710,981 A * 1/1973 Arzberger ..... B67D 1/0044 137/607
4,440,318 A * 4/1984 Berger ..... B67D 1/0035 137/635
4,741,355 A * 5/1988 Credle, Jr. ..... B67D 1/0044 137/269
5,129,549 A * 7/1992 Austin ..... B67D 1/0085 222/129.1
5,960,701 A * 10/1999 Reese ..... B67D 1/0039 222/135
6,039,219 A * 3/2000 Bach ..... B67D 3/0009 141/362
6,554,165 B2 * 4/2003 Cote ..... B65D 1/0276 222/129.1
6,708,741 B1 * 3/2004 Berry ..... B67D 3/0009 141/351
8,167,173 B1 * 5/2012 Simmonds ..... B67D 1/1438 137/595
2010/0083686 A1 * 4/2010 Reels ..... F25D 23/12 62/390
2010/0264160 A1 * 10/2010 Simmonds ..... B67D 1/1405 222/1

* cited by examiner

*Primary Examiner* — Nicholas J Weiss
(74) *Attorney, Agent, or Firm* — Blakely Sokoloff Taylor & Zafman LLP

(57) ABSTRACT

A beverage dispenser having a tank located inside a refrigerator which stores a beverage. A tube connects the tank to a spigot with a plunger and a valve located outside the refrigerator and below the tank. The plunger opens and closes the valve. When the valve is in an open position the beverage flows from the tank, through the tube and is dispensed from the spigot. When the valve is in a closed position, the beverage ceases to flow. Also included is a push bar which when pressed, causes the plunger to move to a position which causes the valve to open. When the push bar is released, the plunger returns to a position which causes the valve to close. In an alternate embodiment, also included are a second tank, tube, spigot and a selector which operates so that the beverage can flow from either tank to its associated spigot.

3 Claims, 5 Drawing Sheets

BEVERAGE DISPENSER FOR REFRIGERATOR

BACKGROUND OF THE INVENTION

Refrigerators having built-in water dispensers mounted on a front door of a refrigerator are well known in the art. Typically, a tube external to the refrigerator is attached to the normal home water supply at one end and to a connector typically at the base of the refrigerator at the other end. The tube then supplies water, under pressure, to a valve which opens and closes to dispense water. The valve is operated from outside the refrigerator door usually by pressing a glass or other container against a push bar which then opens the valve so that water can be dispensed. That is, a glass is placed under a spigot, and the glass is used to press a push bar which opens a valve allowing water from the home to be dispensed into the glass so long as the push bar is depressed. When the push bar is released, the valve closes, and the water ceases to flow. Although tubing which runs through the refrigerator may have a cooling effect on the water which is present in the tube to the extent the tube is passing through refrigerated portion of the refrigerator, once the water which is present in such tubing within the refrigerated portion of the refrigerator has been fully dispensed, additional water will tend to be closer to ambient temperature.

BRIEF SUMMARY OF THE INVENTION

The invention is directed to a beverage dispenser having a tank for holding beverages mounted within a refrigerator. The tank may be placed on a shelf within the refrigerator, or be attached to the inside of the refrigerator door. The only limitation is that the tank must be located at a level which is higher than the level at which the beverage is dispensed so that the beverage can flow from the tank to the dispenser by gravity.

DETAILED DESCRIPTION OF THE INVENTION

Figure 1A:
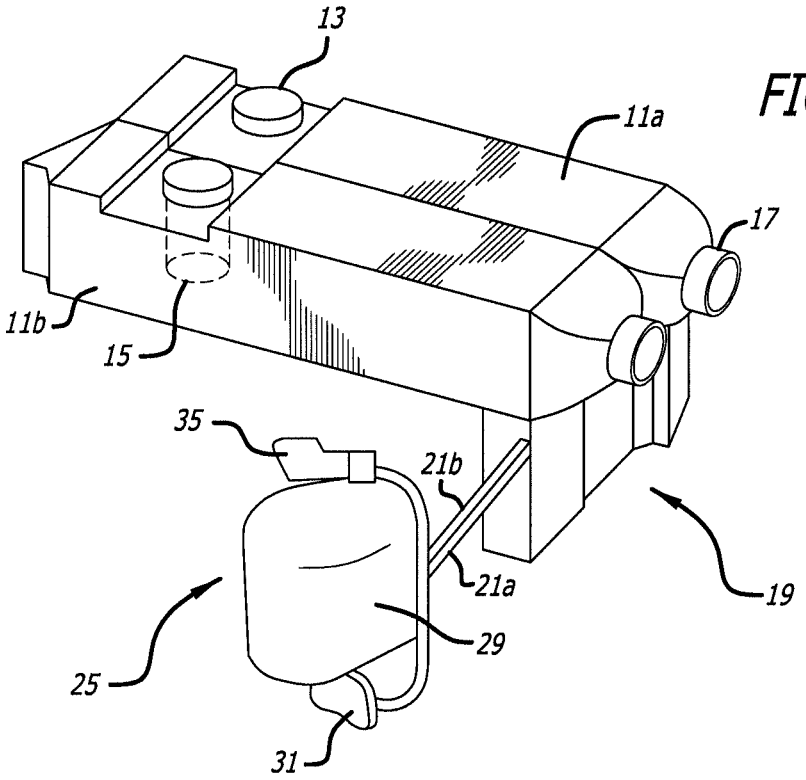
FIG. 1*a* is a perspective view of the invented beverage dispenser with beverage tank.
Figure 1B:
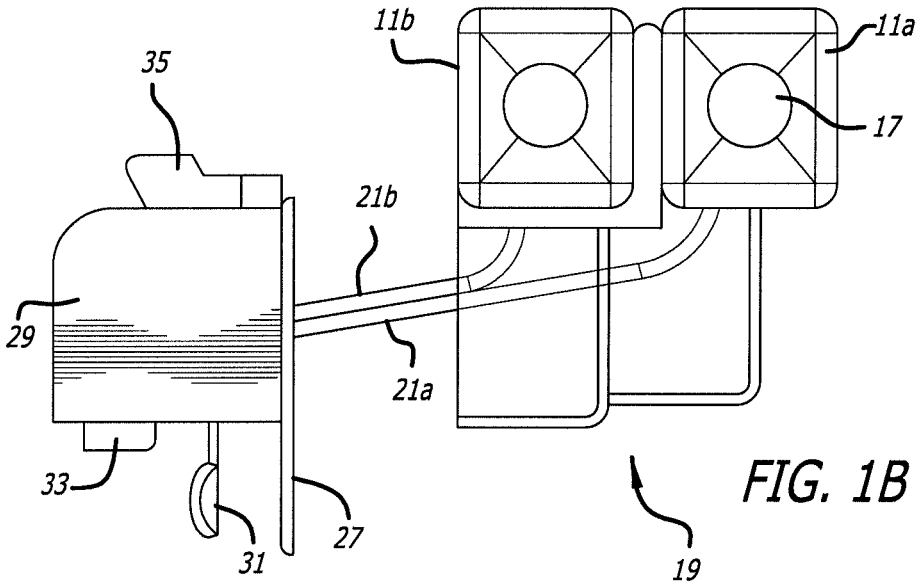
FIG. 1*b* is a side elevation view of the invented beverage dispenser with beverage tank.

Referring first to FIGS. 1*a* and 1*b*, the invention comprises a beverage tank 11*a* mounted on a refrigerator door or on a rack inside the refrigerator (not shown). In another embodiment, there may be a second tank 11*b*. Each tank has an opening with a cap 13 which may be removed and replaced so that when the cap is removed, water or another beverage can be poured into the opening. Preferably, at least one side of the tank is transparent or translucent so that as water or another beverage is poured into the opening, its level can be easily ascertained. When the tank has been filled to the extent desired, the cap is replaced. The cap may be fitted with threads so that it can be screwed onto a mating thread on the tank. However, the specifics of how such cap is used to open and close the tank is not important for a proper understanding of the invention.

Preferably a filter 15 is located under the opening to capture any particles which may be in the water or other beverage being poured into the tank so as to limit any blockage which might otherwise occur without such filter.

Preferably, a second cap 17 is located on a side of each tank. Cap 17 is maintained in place during normal operation. However, if the tank needs to be cleaned or if it is desired to replace the beverage currently in the tank, cap 17 would be removed so that whatever liquid is inside tank 11*a* (or 11*b*) can be easily removed either by siphoning, or removing the tank from its location within the refrigerator, and turning the tank so that water or other beverage flows out of the opening which exists when cap 17 is removed.

Although as the tank is emptied and a vacuum is formed which may prevent water or other beverage from flowing, cap 13 or cap 11 can have a small opening, or the tank itself can have a small opening to allow ambient air to flow into the tank as it empties to prevent a vacuum from forming.

Located below tank 11*a*, also inside the refrigerator, is connector assembly 19. Connector assembly 19 includes a tube 21*a* which extends from the bottom of tank 11*a* through the refrigerator door terminating in a dispenser described below. In the embodiment where there are two tanks, connector assembly 19 also includes a tube 21*b* which extends from the bottom of tank 11*b*. The connector assembly 19 is also located inside the refrigerator on the door and includes a cover as to protect the tubing. Connector assembly 19 connects to the tank and/or shelf in any convenient manner, the specifics of which is not important to an understanding of the invention.

Figure 2A:
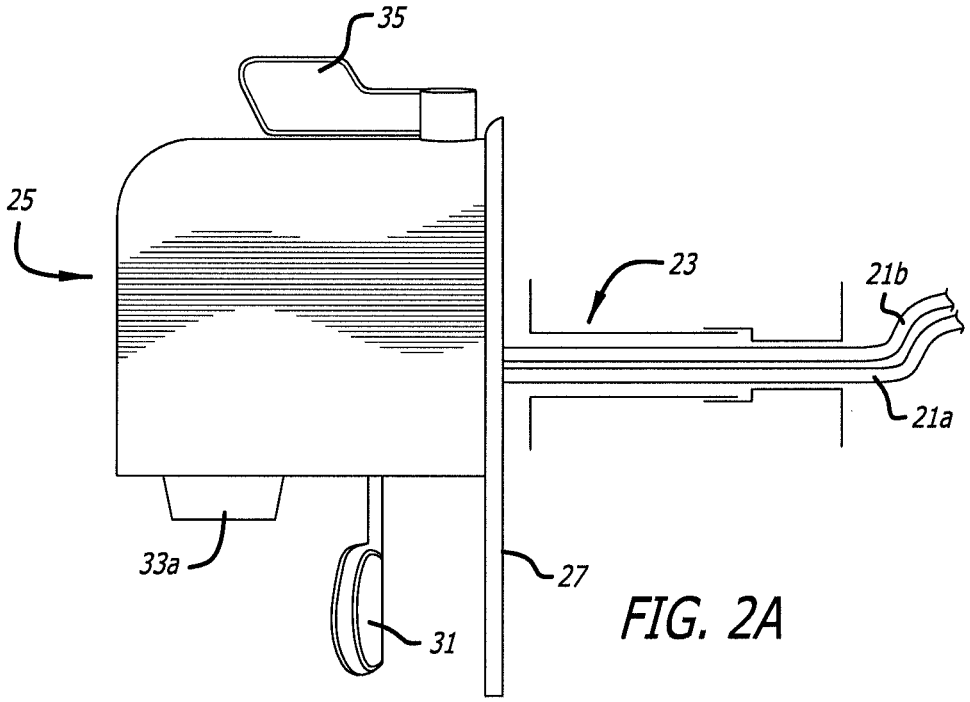
FIG. 2*a* is a perspective view of the invented beverage dispenser with a protective cover.
Figure 2B:
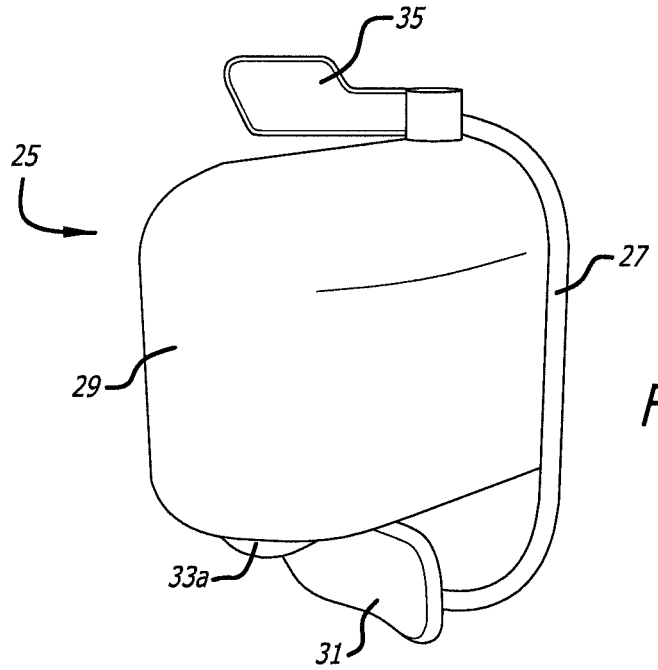
FIG. 2*b* is a side elevation view of the invented beverage dispenser with the protective cover.

Referring next to FIGS. 2*a* and 2*b*, tubing 21*a* (and 21*b*, if present) passes through the refrigerator door, represented in FIG. 2*a* by reference number 23 into dispenser 25. Dispenser 25 includes a mounting plate 27 which is affixed to the outside of refrigerator door 23, cover 29, push bar 31 and spigot 33*a*.

In one embodiment, dispenser 25 also includes a selector 35. The purpose of selector 35 is if two beverage tanks 11*a* and 11*b* are provided, each can have its own tube 21*a* and 21*b* running into dispenser 25. In this case, selector 35 would be used to select the tank from which a beverage is desired to be dispensed when the push bar is depressed. Details of the operation of selector 35 will be described with reference to FIG. 3.

Figure 3A:
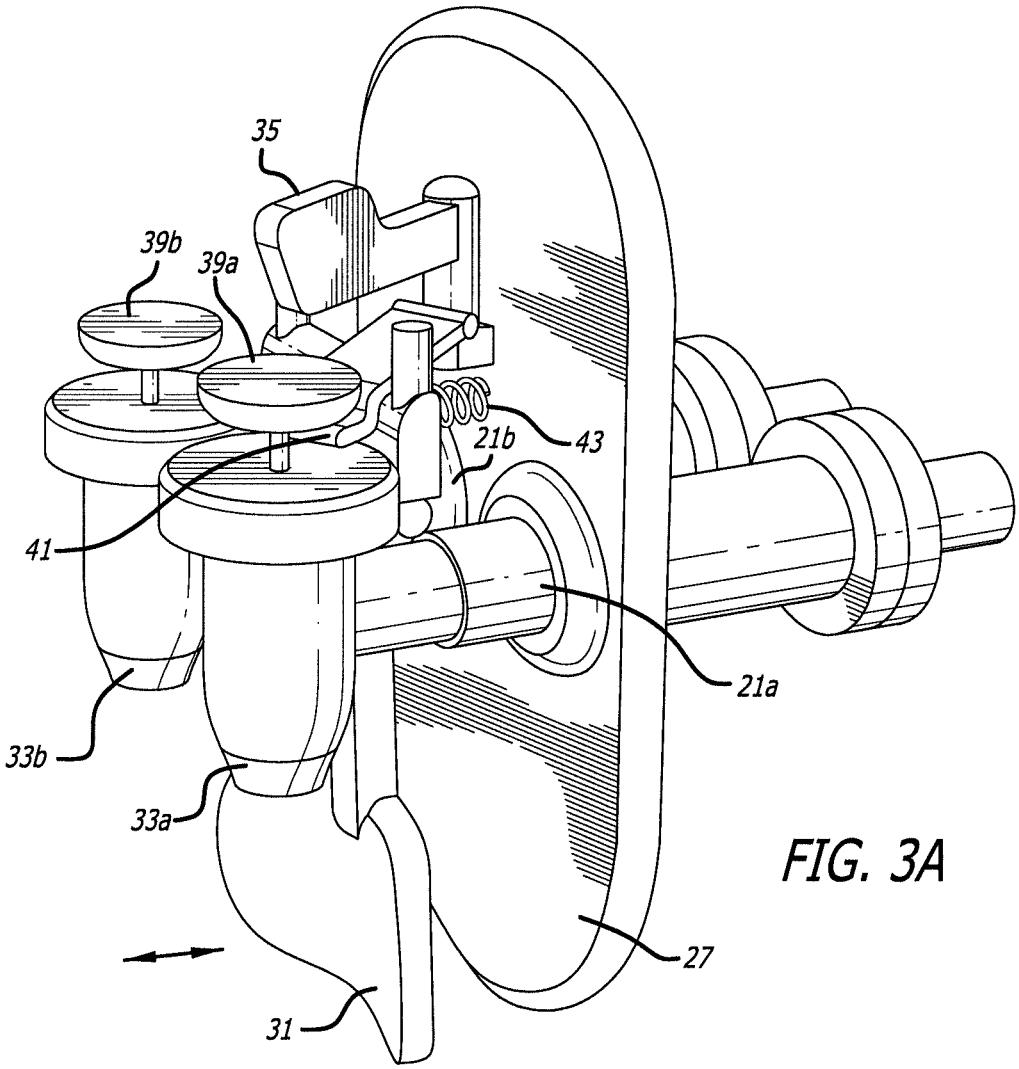
FIG. 3*a* is a detailed perspective view showing the invented beverage dispenser elements inside the protective cover with a pusher bar in its normal position and a selector in a first position.
Figure 3B:
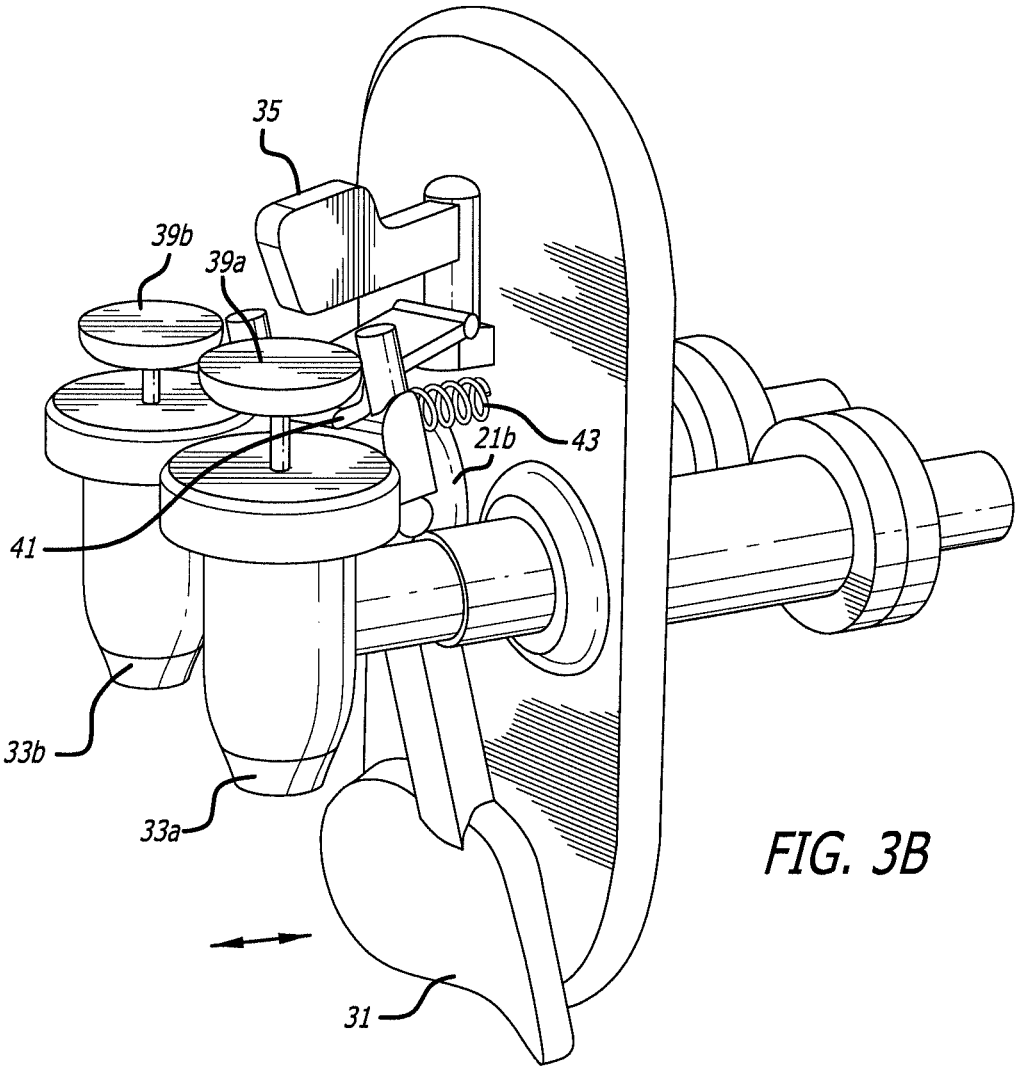
FIG. 3*b* is a detailed perspective view showing the invented beverage dispenser elements inside the protective cover with the pusher bar pushed inward position and the selector in the first position.
Figure 3C:
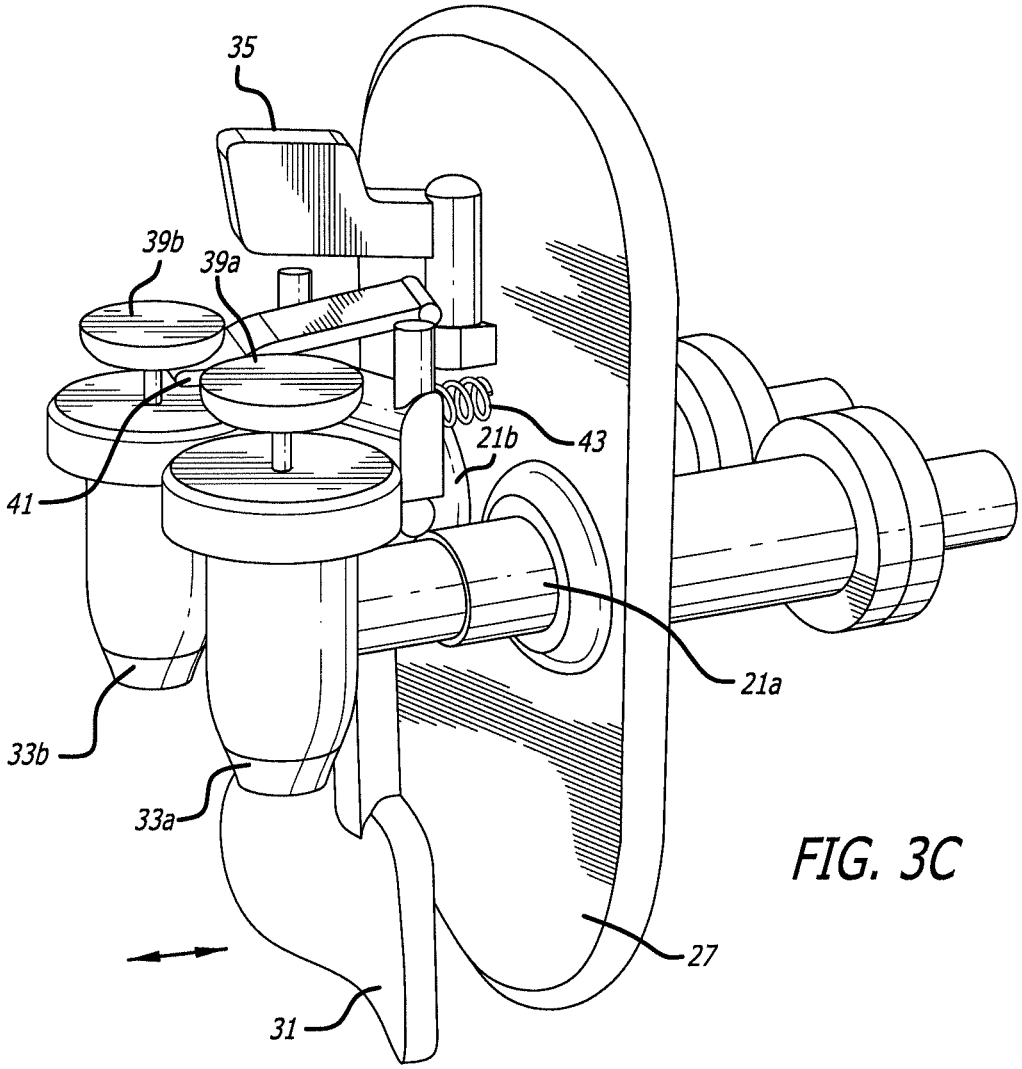
FIG. 3*c* is a detailed perspective view showing the invented beverage dispenser elements inside the protective cover with the pusher bar in its normal position and the selector in a second position.

As shown in FIGS. 3*a*-3*c*, the dispenser which is located outside the refrigerated compartment is attached to an outer surface of door 23 (not shown in FIGS. 3*a*-3*c*) of the refrigerated compartment by mounting plate 27. Spigot 33*a* is located within the dispenser and is coupled to tube 21*a*. As noted above, tube 21*a* includes a portion which passes through an opening in the refrigerator door. Spigot 33*a* includes a plunger 39*a* and an inner valve (not shown). The plunger operates to open and close the valve. When the valve is in an open position, that is with plunger head 39*a* in a raised position, the liquid beverage flows from tank 11*a*, through tube 21*a* and is dispensed from spigot 33*a* and when the valve is in a closed position, that is with plunger head 39*a* in a lowered position, the liquid beverage ceases to flow. That is, when plunger 39*a* is raised, the valve inside spigot 33*a* opens and when plunger 39*a* is lowered, the valve inside spigot 33*a* is closed. During operation, plunger 39*a* is normally in its lowered position and the valve is closed. In the alternate embodiment with two tanks 11*a* and 11*b*, there is a corresponding spigot 33*b* with plunger 39*b* which operates in the same manner as spigot 33*a* as described above.

Also shown in FIGS. 3*a*-3*c* is push bar 31 which is operatively coupled to plunger 39*a* via an extension arm 41 to which the push bar is coupled. One end of extension arm 41 is adjacent to the bottom of plunger 39*a*. The other end of extension arm is pivotally connected to face plate 27 in one embodiment so that the extension arm can move between two positions depending on whether push bar 31 is being pressed. When the push bar is pressed, extension arm 41 is pushed up which causes plunger 39*a* to move to a raised position which causes the valve of spigot 33*a* to open. When the push bar is released, a spring 43 causes push bar 31 to return to its home, vertical position which in turn lowers extension arm 41 and, plunger 39*a*, by operation of a spring (not shown) inside spigot 33*a*, returns to its home, fully lowered position which causes the valve inside spigot 33*a* to close. Although FIGS. 3*a*-3*c* show spigot 33*a* (or spigot 33*b*) operating so that its normally closed position is when plunger 39*a* (or plunger 39*b*) is in a lowered position, extension arm 41, push bar 31 and spigot 33*a* (or spigot 33*b*) can be operatively connected in a different manner, the only requirement being that when push bar 31 is pushed in, spigot 33*a* (or spigot 33*b*) opens so that the beverage in tank 11*a* (or tank 11*b*) flows.

In the alternate embodiment with two tanks 11*a*, and 11*b*, there are two tubes 21*a* and 21*b* and two spigots 39*a* and 39*b*, with tube 21*b* coupled to tank 11*b* at one end and to spigot 33*b* at its other end. In this embodiment, extension arm 41 is pivotally coupled to selector 35 at one end so that when selector 35 is in a first position, a second end of extension arm 41 is adjacent to the bottom surface of plunger 39*a* and the device operates as explained above. When selector 35 is in a second position, the second end of extension arm 41 is adjacent to the bottom surface of plunger 39*b*. In this manner, selector 35 and extension arm 41 cause spigot 33*a* to operate when push bar 31 is pressed and selector 35 is in the first position and cause spigot 33*b* to operate when push bar 31 is pressed and selector 35 is in the second position.

Further details regarding spigots 33*a* and 33*b* are not needed for a proper understanding of the invention since spigots with internal valves having a construction suitable for use in the invention are well known in the art. Additionally, although the foregoing description includes specific parts, connections and relations, the invention should not be construed as being limited to the specific descriptions, but should construed as provided in the following claims.

We claim:

1. A beverage dispenser comprising:

a) a tank for storing a liquid beverage;

b) a tube coupled adjacent to a bottom surface of said tank and configured to allow said liquid beverage to flow through said tube, wherein said tank and said tube are configured to be disposed within a refrigerated compartment;

c) a dispenser configured to be disposed outside said refrigerated compartment and below said tank, said dispenser including:

i) a spigot disposed within said dispenser and coupled to said tube, said tube including a portion which passes through an opening in said refrigerated compartment, said spigot including a plunger and a valve, said plunger for opening and closing said valve, wherein when said valve is in an open position said liquid beverage flows from said tank, through said tube and is dispensed from said spigot and when said valve is in a closed position, said liquid beverage ceases to be dispensed from said spigot; and ii) a push bar operatively coupled to said plunger and configured so that when said push bar is pressed, said plunger moves to a position which causes said valve to open and when said push bar is released said plunger returns to a position which causes said valve to close;

e) a second tank for storing a second liquid beverage;

f) a second tube coupled adjacent to a bottom surface of said second tank and configured to allow said second liquid beverage to flow through said second tube, wherein said second tank and said second tube are configured to be disposed within said refrigerated compartment;

wherein said dispenser includes:

i) a second spigot disposed within said dispenser and coupled to said second tube, said second tube including a portion which passes through said opening or a second opening in said refrigerated compartment, said second spigot including a second plunger and a second valve, said second plunger for opening and closing said second valve, wherein when said second valve is in an open position said second liquid beverage flows from said second tank, through said second tube and is dispensed from said second spigot and when said second valve is in a closed position, said second liquid beverage ceases to be dispensed from said second spigot; and ii) a selector including an extension arm configured to cause said first spigot to operate only when said selector is in a first position and to cause said second spigot to operate only when said selector is in a second position, wherein said extension arm at one end is in a first position adjacent to a bottom surface of said first plunger when said selector is in said first position and said extension arm at said one end is in a second position adjacent to a bottom surface of said second plunger when said selector is in said second position, wherein said extension arm is pivotably coupled to said selector at a second end and pivotal movement of said selector causes said second end of said extension arm to move between said first position and said second position.

2. The dispenser defined by claim 1 wherein said dispenser further comprises:

a) a face plate which is attachable to an outer surface of a door of said refrigerated compartment and b) a spring coupled to said face plate and to said push bar, wherein said spring normally maintains said push bar in a substantially vertical orientation and when expanded by a pressure applied to said push bar, allows said push bar to move towards said face plate, causing said plunger to move in said direction causing said valve to open.

3. The dispenser defined by claim 1 wherein said dispenser further comprises:

a) a face plate which is attachable to an outer surface of a door of said refrigerated compartment;

b) a spring coupled to said face plate and to said push bar, wherein said spring normally maintains said push bar in a substantially vertical orientation and when expanded by a pressure applied to said push bar, allows said push bar to move towards said face plate, causing said extension arm to cause said first spigot to operate when said selector is in said first position and to cause said second spigot to operate when said selector is in said second position.

* * * * *